US005758851A

United States Patent [19]

Remmers

[11] Patent Number: 5,758,851

[45] **Date of Patent: *Jun. 2, 1998**

[54] ADD-A-ROD BRACKET ASSEMBLY

[75] Inventor: Lee Remmers, Ocala, Fla.

[73] Assignee: Clairson, Inc., Newark, Del.

[ * ] Notice: The term of this patent shall not extend beyond the expiration date of Pat. No. 5,492,295.

[21] Appl. No.: 646,085

[22] Filed: May 7, 1996

[51] Int. Cl.[6] ..... A47H 1/14

[52] U.S. Cl. ..... 248/251; 248/201; 248/222.51; 248/304; 211/105.1; 211/162

[58] Field of Search ..... 248/251, 304, 248/305, 317, 339, 340, 201, 222.51; 211/90, 94, 105.1, 106, 123, 162, 181

[56] References Cited

U.S. PATENT DOCUMENTS

| | | | |
|---|---|---|---|
| 3,141,556 | 7/1964 | Klosterman | 211/162 |
| 3,765,634 | 10/1973 | Stempel | 248/250 |
| 3,972,499 | 8/1976 | Simmons | 248/224 |
| 4,316,593 | 2/1982 | Miner et al. | 248/250 |
| 4,340,144 | 7/1982 | Cousins | 211/87 |
| 4,671,419 | 6/1987 | Beverly | 211/105.1 |
| 4,842,230 | 6/1989 | Cobb et al. | 248/225.2 |
| 5,050,750 | 9/1991 | Mason | 211/123 |
| 5,350,072 | 9/1994 | Rogers et al. | 211/123 |
| 5,351,842 | 10/1994 | Remmers | 211/90 |
| 5,405,026 | 4/1995 | Lee et al. | 211/123 |
| 5,492,295 | 2/1996 | Remmers | 248/251 |
| 5,531,416 | 7/1996 | Remmers | 248/222.51 |

*Primary Examiner*—Leslie A. Braun
*Assistant Examiner*—Anita U. Kina
*Attorney, Agent, or Firm*—Middleton & Reutlinger; Charles G. Lamb

[57] ABSTRACT

An add-a-rod bracket assembly for receiving a hanger rod, particularly for clothes, includes a mounting block in an upper portion of the bracket assembly wherein the mounting block includes a pair of horizontally extending grooves in vertically spaced alignment along a front of the mounting block for receiving longitudinally extending wires of a wire shelf and at least a pair of spaced horizontally extending grooves on a top portion of the mounting block for receiving the transversely extending wires of a wire shelf. The bracket assembly terminates at a lower portion with a U-shaped cradle sized to receive a hanger rod therein, particularly a rod for clothes hangers.

7 Claims, 4 Drawing Sheets

ADD-A-ROD BRACKET ASSEMBLY

BACKGROUND OF THE INVENTION

The invention relates to bracket assemblies for attachment to wire shelves. More particularly the present invention relates to a bracket assembly which is mounted to the wires of a wire shelf wherein the bracket assembly is provided with means to receive an additional rod member thereon.

There are a number of different types of shelves which are mounted into closets wherein the shelves are adaptable for stacking clothes and other objects thereon for storage as well as for hanging clothes and the like thereon. Many of these shelves are comprised of parallel wires or rods which extend longitudinally of the closet as well as other support wires which run transverse of the closet to add strength and support to the longitudinally extending wires. Moreover, there are commercially available a number of different attachments made for being attached to these shelf wires which provides for additional versatility themselves.

SUMMARY OF THE INVENTION

It is an object of the present invention to provide bracket assembly means for adding an additional longitudinally extending rod to a closet.

It is a further object of the present invention to provide a bracket assembly for detachably connecting to support wires of a wire shelf wherein the bracket assembly includes a cradle at its lower extremity for receiving a longitudinally extending rod therein.

It is even another object of the present invention to provide a bracket assembly for attachment to longitudinally extending wires of a wire shelf whereby the bracket assembly has means to receive a clothes hanger rod therein.

It is also an object of the present invention to provide a bracket assembly for attachment to a wire shelf whereby clothes hangers may be slidably received upon a longitudinally extending rod received within a U-shaped cradle provided in the bracket assembly.

More particularly, the present invention provides an add-a-rod bracket assembly comprising: a bracket body having an upper portion and a lower portion, the upper portion including a shelf mounting block having a plurality of vertically spaced grooves therein to receive longitudinally extending shelf wires along a front of the block and horizontally spaced grooves along a top of the block to receive transversely extending shelf wires; and, an upwardly extending U-shaped cradle on said lower portion of said bracket body.

It is to be understood that the description of the examples of the present invention are not by way of limitation. Various modifications within the scope of the present invention will be apparent to those skilled in the art upon reading the disclosure set forth hereinafter.

DETAILED DESCRIPTION OF THE PREFERRED EMBODIMENT

Figure 1:
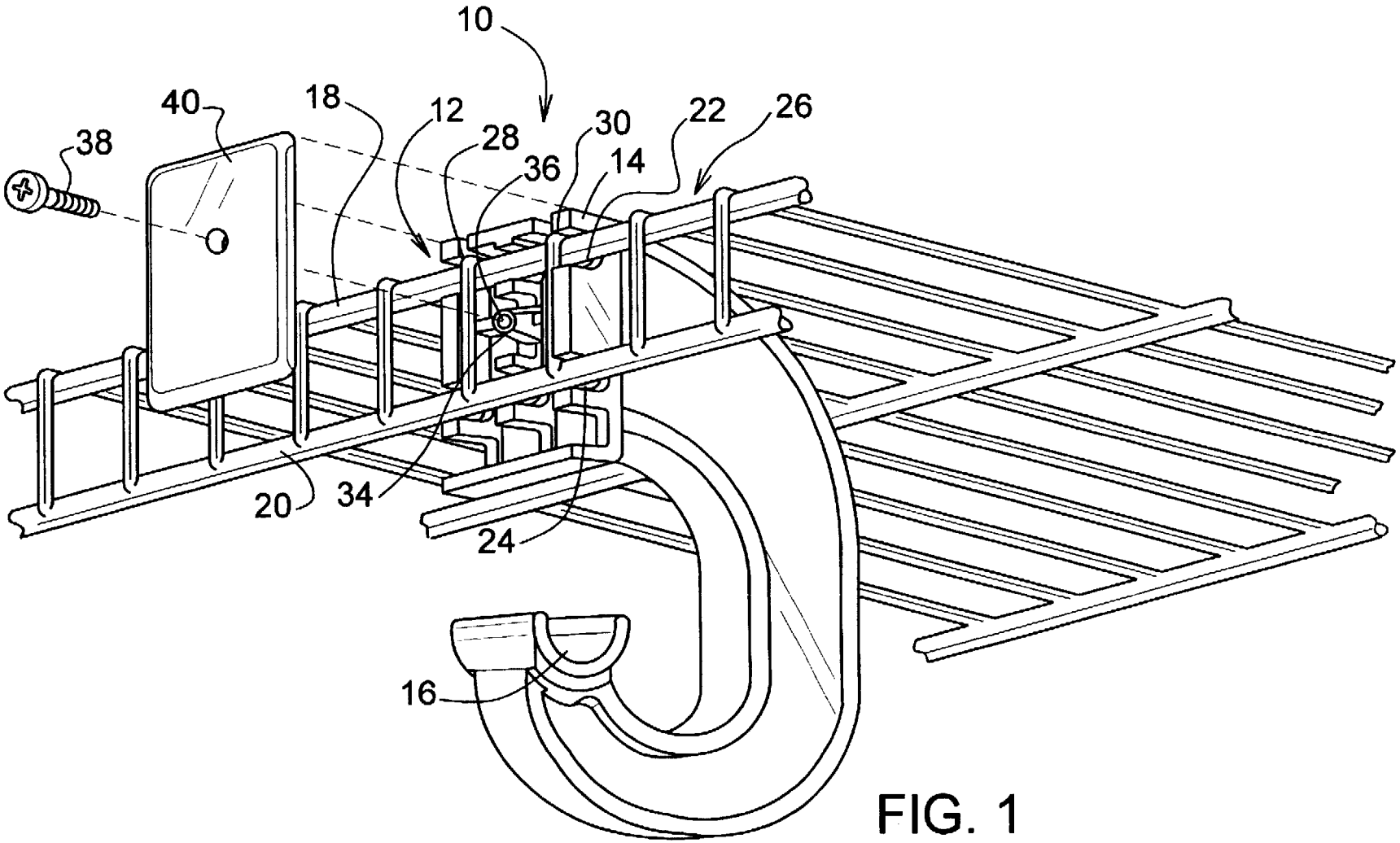
FIG. 1 is an explosive view of an add-a-rod bracket assembly of the present invention attached to a wire shelf.

As shown in the Figures, an add-a-rod bracket assembly 10 of the present invention is attached to a wire shelf 26 and is particularly useful for receiving a clothes hanger rod 32 thereon. The wire shelf 26 is generally comprised of a plurality of longitudinally extending wires, identified by the numeral 18 for the top wire of the front wire of the shelf and by the numeral 20 for the bottom front wire of the shelf. Transverse wires 28 are also provided for support for the wire shelf 26 and the transversely extending wires 28 extend from the back of the shelf to the front of the shelf and over the top front wire 18 and terminate at and are connected to the bottom front wire 20.

The add-a-rod bracket assembly 10 is provided with a mounting assembly 12 which includes a mounting block 14. The mounting block 14 is provided with a pair of horizontally extending grooves vertically spaced along the front of the mounting block 14 to receive the longitudinally extending wires 18 and 20 therein. The groove to receive the longitudinally extending wire 18 is identified by the numeral 22 and the groove receiving the bottom longitudinally extending wire 20 is identified by the numeral 24. The grooves 22 and 24 are opened outwardly from the front of the bracket assembly 10. Along the top of the mounting block 14 are a pair of horizontally extending grooves 30 which are in horizontally spaced parallel alignment to receive the transversely extending wires 28. Grooves 30 are open upwardly and extend from the front of the mounting block 14 to the back of the mounting block 14. Moreover, as shown in FIG. 1 mounting block 14 is provided with a collar 34 which extends outwardly from the front of the block 14. Collar 34 includes a tapered bore 36 therein to receive a cover screw 38 which is utilized to mount the cover 40 to the mounting block 14.

Figure 5:
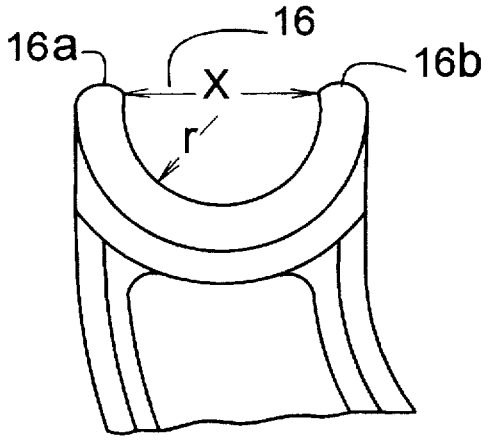
FIG. 5 is an enlarged side view of one element of the present invention.
Figure 3:
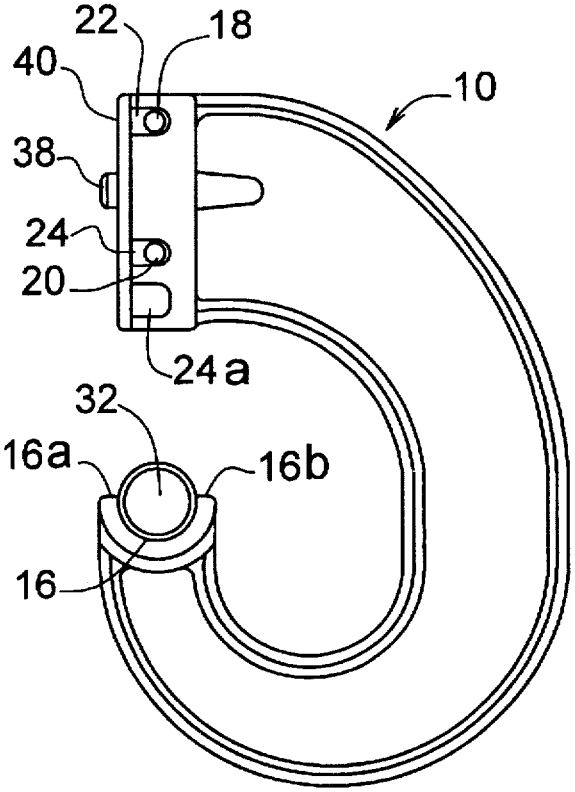
FIG. 3 is a side view of the add-a-rod bracket assembly of FIG. 2.

The add-a-rod bracket assembly 10 is of generally J-shaped configuration with the mounting block 14 being at the top of the J and a U-shaped cradle 16 is provided at the lower terminating end of the bracket assembly. The U-shaped cradle 16 opens upwardly and has a radius of curvature substantially the same as a clothes hanger rod 32 received therein. Preferably, as best shown in FIG. 5, cradle 16 is provided with tip ends **16*a* and 16*b* wherein the distance x between the tip ends 16*a*, 16*b* is less than the diameter of the rod 32 which is received within cradle 16. This allows means for rod 32 to be "snapped" into cradle 16. For example, for a radius of curvature r being 0.372 inches, the distance x would be less than 2 times r such as, x being 0.728 inches. Also, as best shown in FIG. 3, the central axis of the U-shaped cradle 16 is in vertical alignment with the central axis of the grooves 22 and 24 so that the U-shaped cradle 16 is substantially vertically aligned with the longitudinally extending wires 18 and 20 which are received within the grooves 22 and 24. Moreover, the J-shaped bracket assembly 10 is provided with a lower curved portion wherein the lower curved portion 36 has a depth greater than the terminating end 48 of the hook portion 23 of a clothes hanger which is slidably received upon the clothes hanger rod 32. Thus, the clothes hanger can slide past and over the J-shaped add-a-rod bracket assembly 10** when in use.

Figure 4:
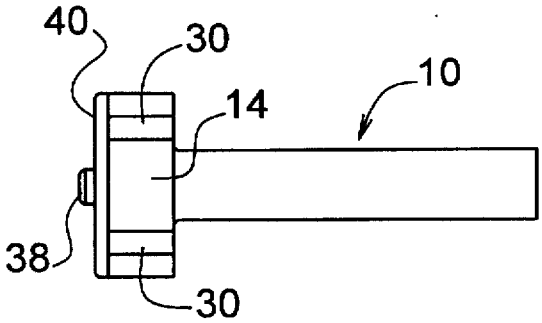
FIG. 4 is a top view of FIG. 3.

As best shown in FIG. 4, the grooves 30 are spaced substantially the same distance apart as spacing between two transversely extending wires 28 of the wire shelf and as shown in FIG. 3, the spacing between the grooves 22 and 24 is generally the same spaced distance as between front wires 18 and 20 of the wire shelf 26.

Figure 2:
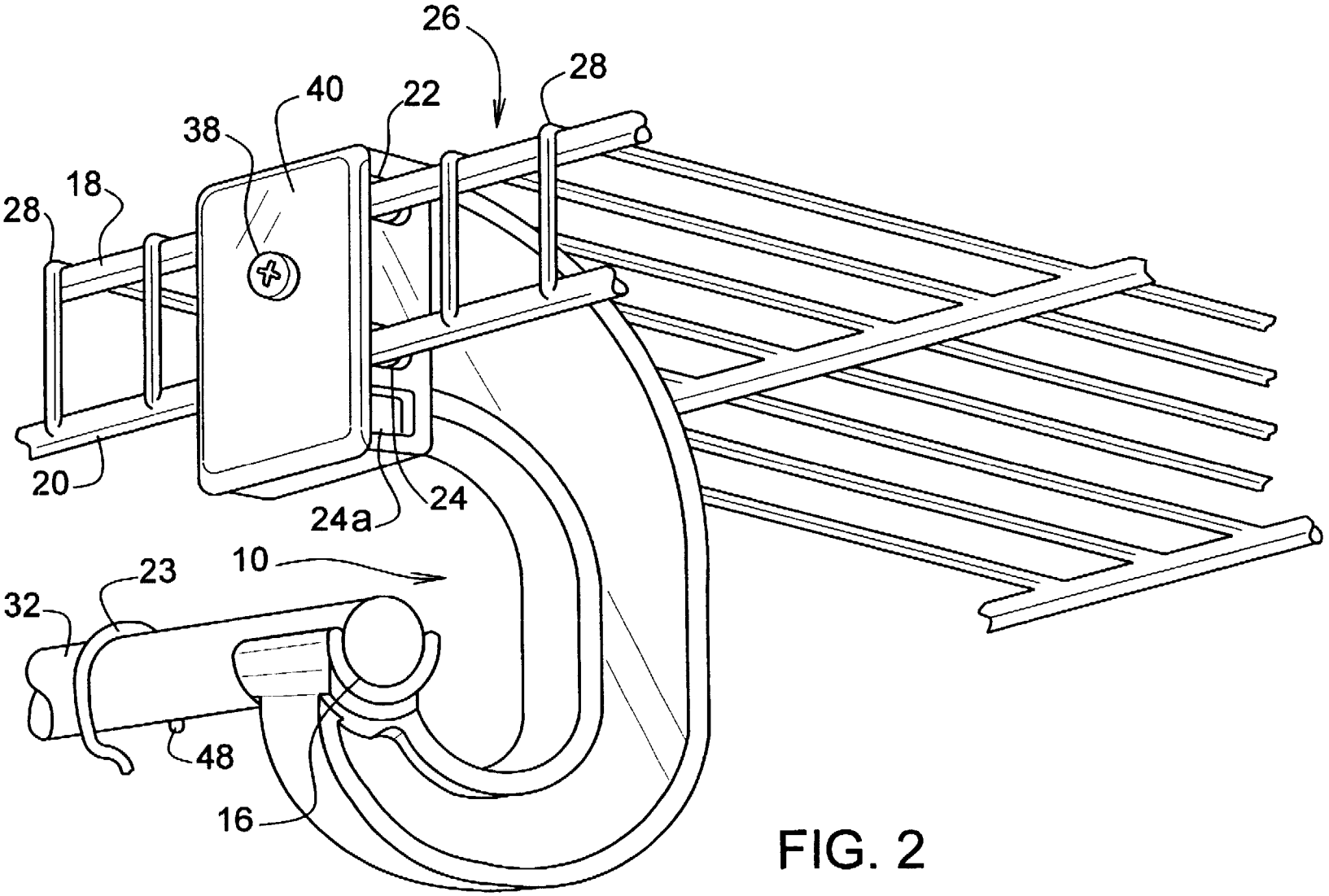
FIG. 2 is a perspective view of the add-a-rod bracket assembly of FIG. 1 with an additional rod received by the bracket assembly.
Figure 6:
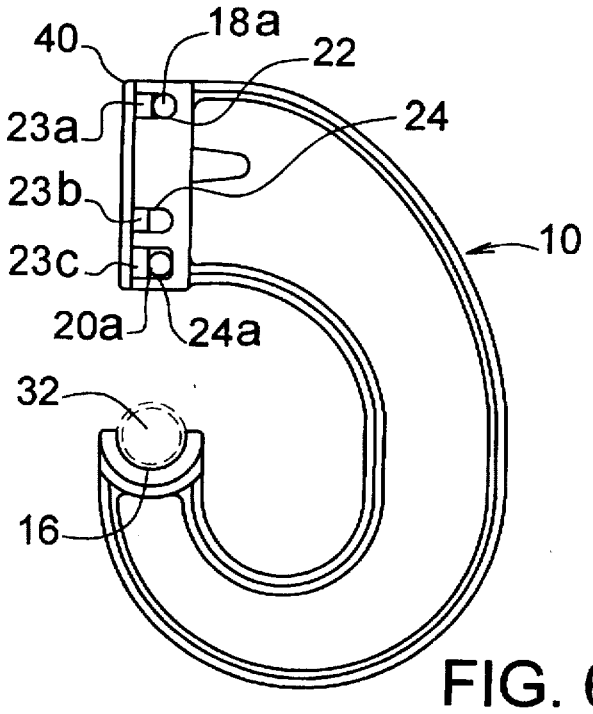
FIG. 6 is a side view of a variation of the add-a-rod bracket.assembly as shown in FIG. 2.

As shown in FIG. 6, the add-a-rod bracket assembly 10 is attached to a wire shelf which is provided with longitudinally extending edge wires 18*a* and 20*a* which are shown as being slightly larger than the rods of the wire shelf 26 in FIGS. 1–3 and also the spacing between the longitudinally extending edge wires 18*a* and 20*a* is greater than in FIGS. 1–3. In order to accommodate these larger diameter edge wires 18*a* and 20*a*, as well as the smaller edge wires 18 and 20, tabs 23*a*, 23*b* and 23*c* are provided to snap into the grooves 22, 24 and 24*a*, as appropriate, thereby holding the different types of shelving tightly in place.

Figure 7:
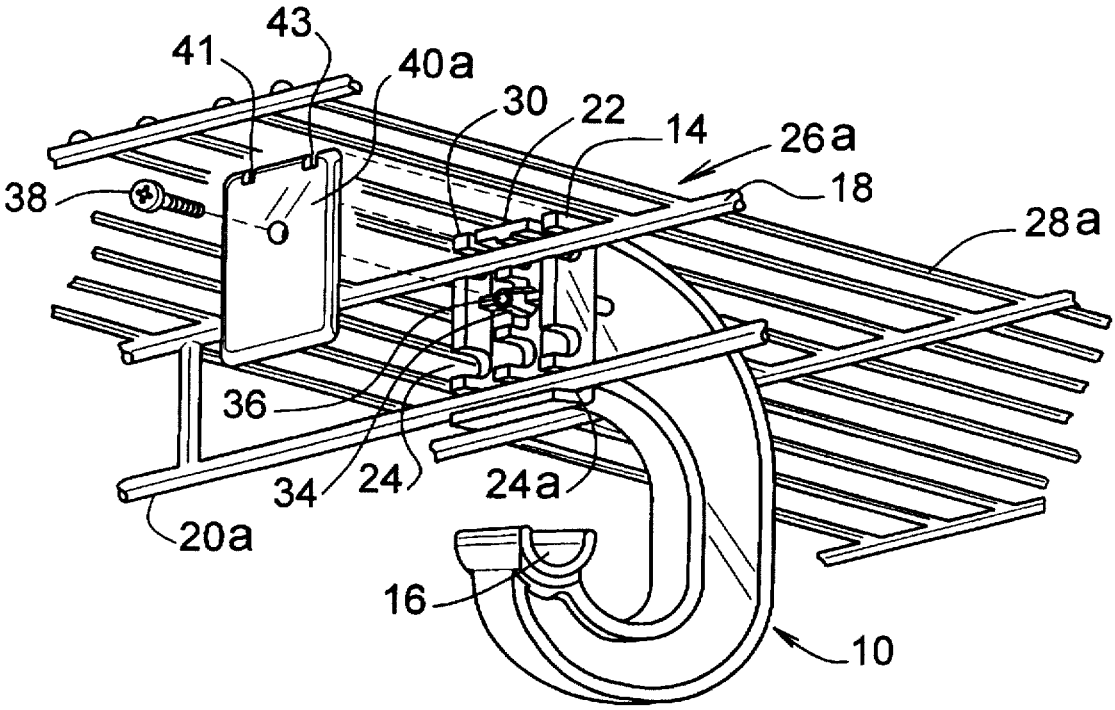
FIG. 7 is a partial exploded view of another embodiment of an add-a-rod bracket assembly of the present invention attached to a wire shelf.

As shown in FIG. 7, add-a-rod bracket assembly 10 of the present invention may be used with different size wire shelves wherein the add-a-rod bracket assembly is placed intermediate of the wire shelf as opposed to being placed to receive the edge wires. As shown in FIG. 7, the add-a-rod bracket assembly 10 receives the longitudinally extending rods 18 and 20*a* therein of a wire shelf 26*a*. The wire shelf 26*a* is provided with transverse support wires 28*a* which extend across the add-a-rod bracket assembly and are received within the grooves 30 in the same manner as horizontally extending transverse wires 28 as shown in FIGS. 1–3. Also, the cover 40 of the add-a-rod bracket assembly 10 has been modified and is identified by the numeral 40*a*. In the modification, grooves 41 and 43 are provided to receive the transverse wires 28*a* therein as they extend horizontally across the cover 40*a*.

In use, the add-a-rod bracket assembly 10 is configured so that the mounting block 14 is inserted to receive the transversely extending wires 28 in the grooves 30 and the longitudinally extending wires 18 and 20 are received within the grooves 22 and 24. The cover 40 is then placed over the front of the mounting block 14 and the threaded screw member 38 is inserted through cover 40 and received within the collar 34. A second add-a-rod bracket assembly 10 (not shown) is generally then placed at a preselected distance along the wire shelf 26 at a preselected distance along the wire shelf 26 and attached essentially the same as described previously. After at least two of the add-a-rod bracket assemblies have been positioned at preselected locations along the wire shelf 26, a hanger rod 32 is then placed within the U-shaped cradles 16 of the bracket assemblies 10. Furthermore, a plurality of bracket assemblies 10 may be spaced along the shelf 26 and a plurality of rods 32 may be placed end to end longitudinally therealong.

It will be realized that various changes may be made to the specific embodiment shown and described without departing from the scope and spirit of the present invention.

What is claimed is:

1. An add-a-rod bracket assembly comprising:

a bracket body having an upper portion and a lower portion, said upper portion including a shelf mounting block, said shelf mounting block having a front and a top;

a pair of horizontally extending first wire-receiving grooves in vertical spaced alignment along said front of said mounting block;

a pair of horizontally extending second wire-receiving grooves in horizontally spaced alignment along said top of said mounting block; and, an upwardly extending U-shaped cradle on said lower portion of said bracket body.

2. The bracket assembly of claim 1, said body being of generally J-shaped configuration.

3. The bracket assembly of claim 2, said U-shaped cradle being at a terminating end of said lower portion.

4. The bracket assembly of claim 3, said lower portion having a recess therein of a depth and width sufficient to receive clothes hangers thereacross.

5. The bracket assembly of claim 1, said first grooves being open in an outward direction and said second grooves being open in an upward direction.

6. The bracket assembly of claim 1, said bracket body having means to receive a cover for said first grooves of said mounting block.

7. The bracket assembly of claim 6 including a cover mounted over said first grooves.

* * * * *